US006648442B2

(12) United States Patent
Bauer

(10) Patent No.: US 6,648,442 B2
(45) Date of Patent: Nov. 18, 2003

(54) COMPENSATION FOR TEMPERATURE DEPENDENT DROP QUANTITY VARIATION

(75) Inventor: Stephen W Bauer, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 243 days.

(21) Appl. No.: 09/840,794

(22) Filed: Apr. 23, 2001

(65) Prior Publication Data

US 2002/0154185 A1 Oct. 24, 2002

(51) Int. Cl.[7] ..... B41J 29/38
(52) U.S. Cl. ..... 347/14
(58) Field of Search ..... 347/14, 9, 10

(56) References Cited

U.S. PATENT DOCUMENTS

| | | | | |
|---|---|---|---|---|
| 4,675,696 A | * | 6/1987 | Suzuki | 347/14 |
| 5,168,284 A | | 12/1992 | Yeung | 347/17 |
| 5,172,142 A | * | 12/1992 | Watanabe et al. | 347/14 |
| 5,206,668 A | | 4/1993 | Lo et al. | 347/6 |
| 5,315,316 A | | 5/1994 | Khormaee | 347/3 |
| 5,343,231 A | * | 8/1994 | Suzuki | 347/14 |
| 5,418,558 A | | 5/1995 | Hock et al. | 347/14 |
| 5,475,405 A | | 12/1995 | Widder et al. | 347/14 |
| 5,635,968 A | | 6/1997 | Bhaskar et al. | 347/59 |
| 5,644,343 A | | 7/1997 | Allen | 347/17 |
| 5,699,090 A | | 12/1997 | Wade et al. | 347/7 |
| 6,132,021 A | | 10/2000 | Smith et al. | 347/6 |
| 6,196,651 B1 | | 3/2001 | Zuber et al. | 347/7 |

* cited by examiner

*Primary Examiner*—Stephen D. Meier
*Assistant Examiner*—Julian D. Huffman
(74) *Attorney, Agent, or Firm*—Gregg W. Wisdom

(57) ABSTRACT

An embodiment of a temperature compensations system at least partially compensates for temperature induced changes in the mass of drops ejected from printheads in an inkjet printer. A value representing the temperatures of cyan, magenta, yellow, and black printheads is provided to a controller. Using these values, the controller adjusts KCMY color values associated with each pixel to form transformed color values for a swath. A halftone operation is performed upon these transformed color values for the swath. The results of the halftone operation are used by the controller to determine the printheads that must eject drops of ink onto the pixels within the swath and to determine the number of passes of the printheads across the swath to form the portion of the image on the media corresponding to the swath. The controller determines the transformed color values to at least partially compensate for the increased drop mass so that the image formed on the swath approximates the image that would have been formed on the swath without the temperature changes in the printheads.

29 Claims, 6 Drawing Sheets

COMPENSATION FOR TEMPERATURE DEPENDENT DROP QUANTITY VARIATION

FIELD OF THE INVENTION

This invention relates to thermal inkjet imaging. More particularly, this invention relates to a method and apparatus to compensate for drop quantity variation.

BACKGROUND OF THE INVENTION

High fidelity reproduction of images on media in inkjet imaging operations is more effectively accomplished if the quantity of colorants deposited onto the media can be carefully controlled. The quantity of ink ejected from the nozzles can vary between ejections. These variations increase the difficulty of accurately reproducing the color of the image on the media. A need exists for a method and apparatus to more effectively control the quantity of ink deposited onto media during an imaging operation.

SUMMARY OF THE INVENTION

Accordingly, a method includes receiving a value related to a temperature of a printhead and determining a function value related to an ink drop quantity ejected by the printhead using the value. The method further includes transforming an intensity value using the function value to form a transformed intensity value.

A temperature compensation system includes a temperature sensor configured to provide a signal related to a temperature of a printhead. In addition, the temperature compensation system includes a controller arranged to receive the signal and configured to determine a value related to an ink drop quantity ejected by the printhead and configured to determine a transformed intensity value using the value and an intensity value.

An inkjet imaging device to form an image on media corresponding to image data includes a printhead arranged to receive drive signals and configured to eject ink onto the media according to the drive signals. In addition, the inkjet imaging device includes a temperature sensor configured to provide a signal related to a temperature of the printhead. Furthermore, the inkjet imaging device includes a controller arranged to receive the signal and the image data. With the controller configured to determine a value related to ink drop quantity ejected by the printhead, configured to determine an intensity value from the image data, configured to determine a transformed intensity value using the value and the intensity value, and configured to generate data using the transformed intensity value. The inkjet imaging device also includes a driver circuit arranged to receive the data and configured to generate the drive signals according to the data.

DESCRIPTION OF THE DRAWINGS

A more thorough understanding of embodiments of the temperature compensation system may be had from the consideration of the following detailed description taken in conjunction with the accompanying drawings in which:

Shown in FIG. 1A is a graphical representation of the formation of a neutral gray region.

Figure 1A:
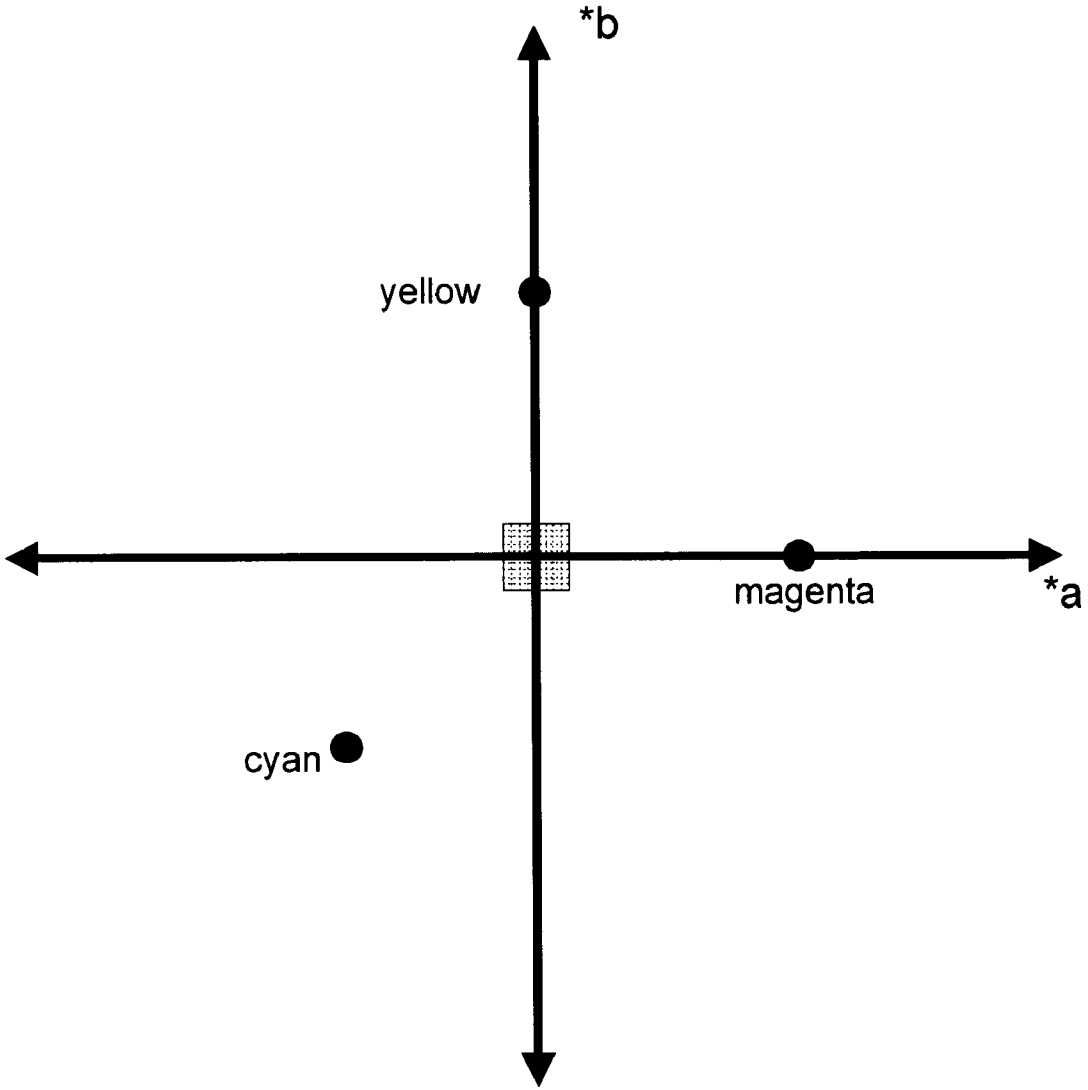
Figure 1B:
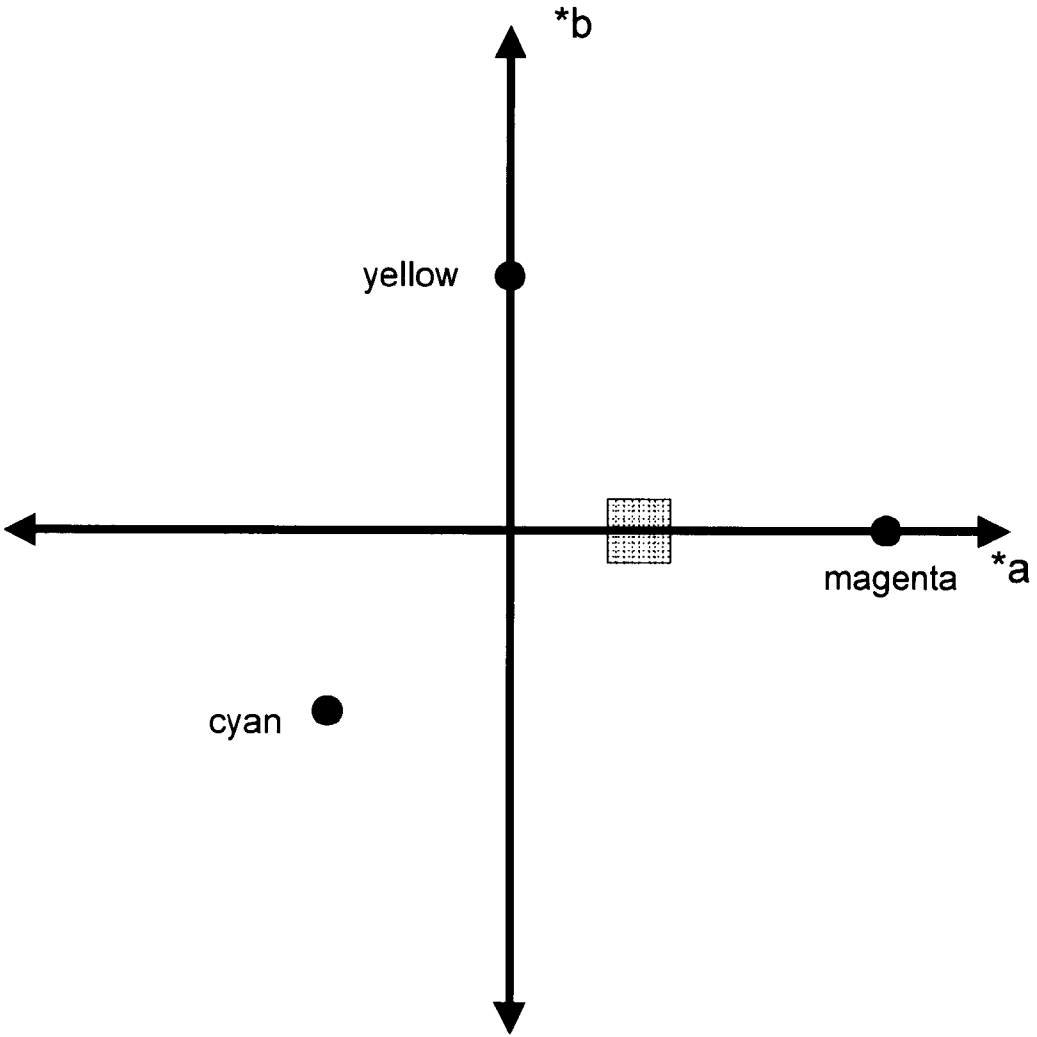

Shown in FIG. 1B is a graphical representation of effect of an uncompensated increase in drop quantity upon the color the neutral gray region.

Figure 2:
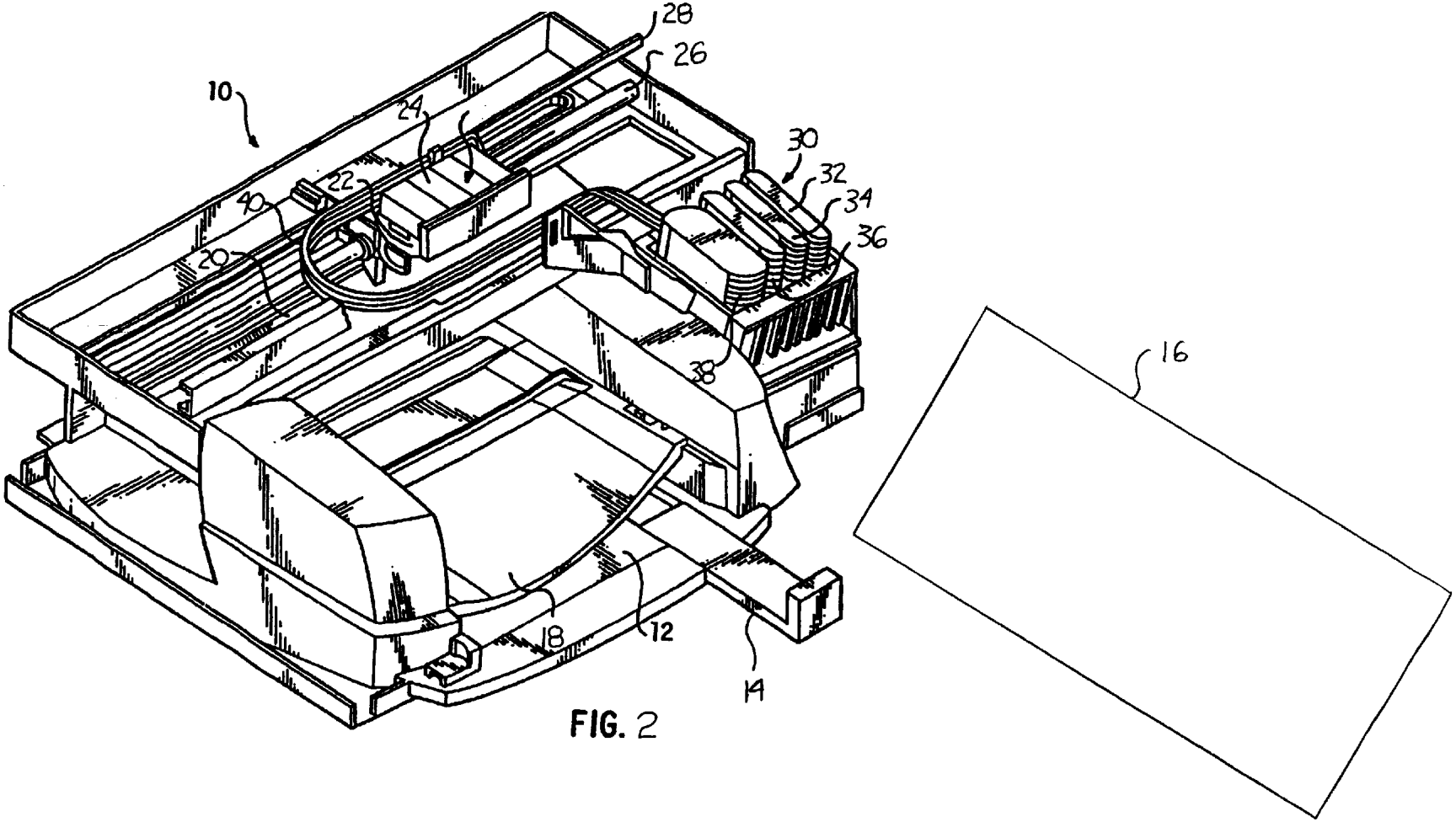

Shown in FIG. 2 is a perspective drawing of an inkjet printer.

Figure 3A:
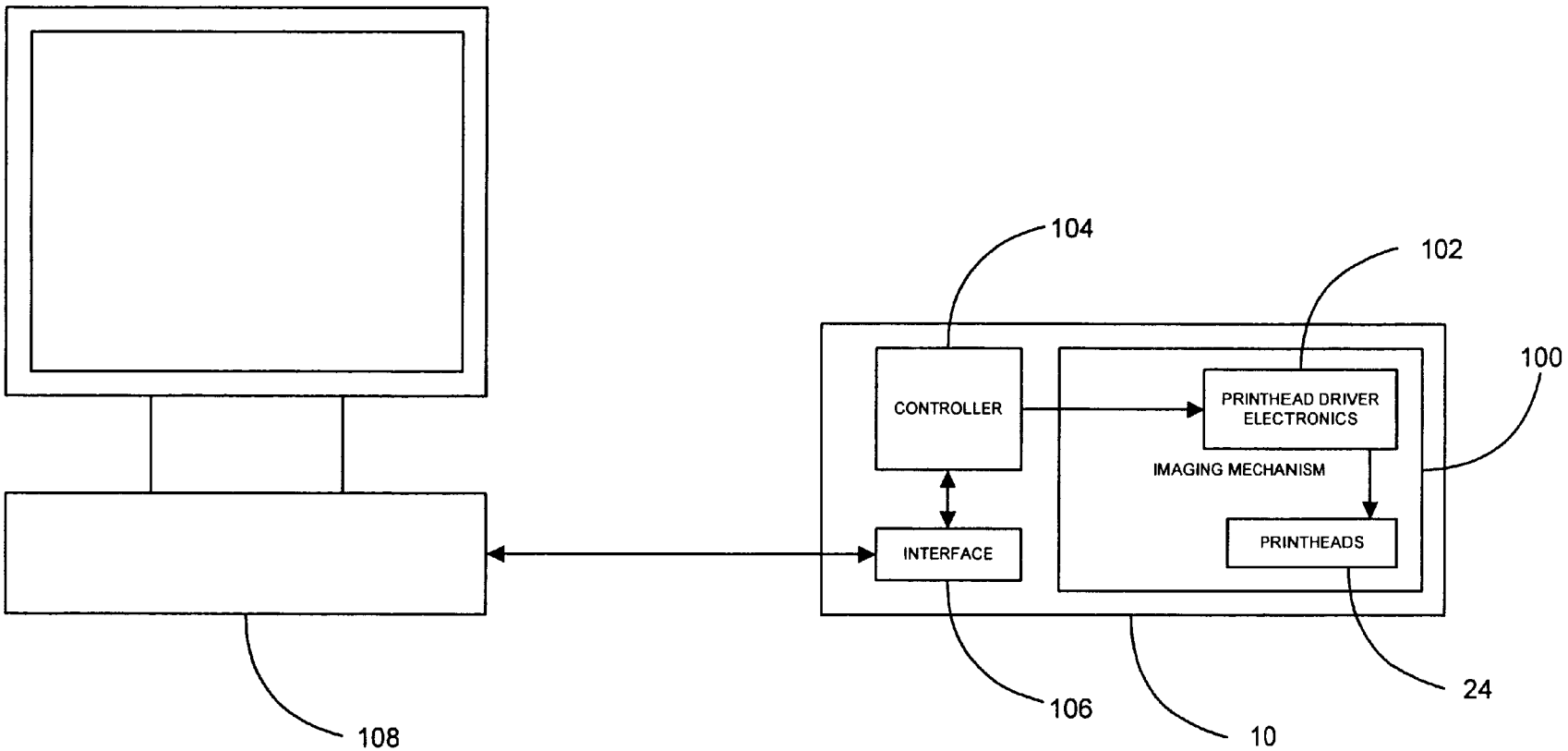
Figure 3B:
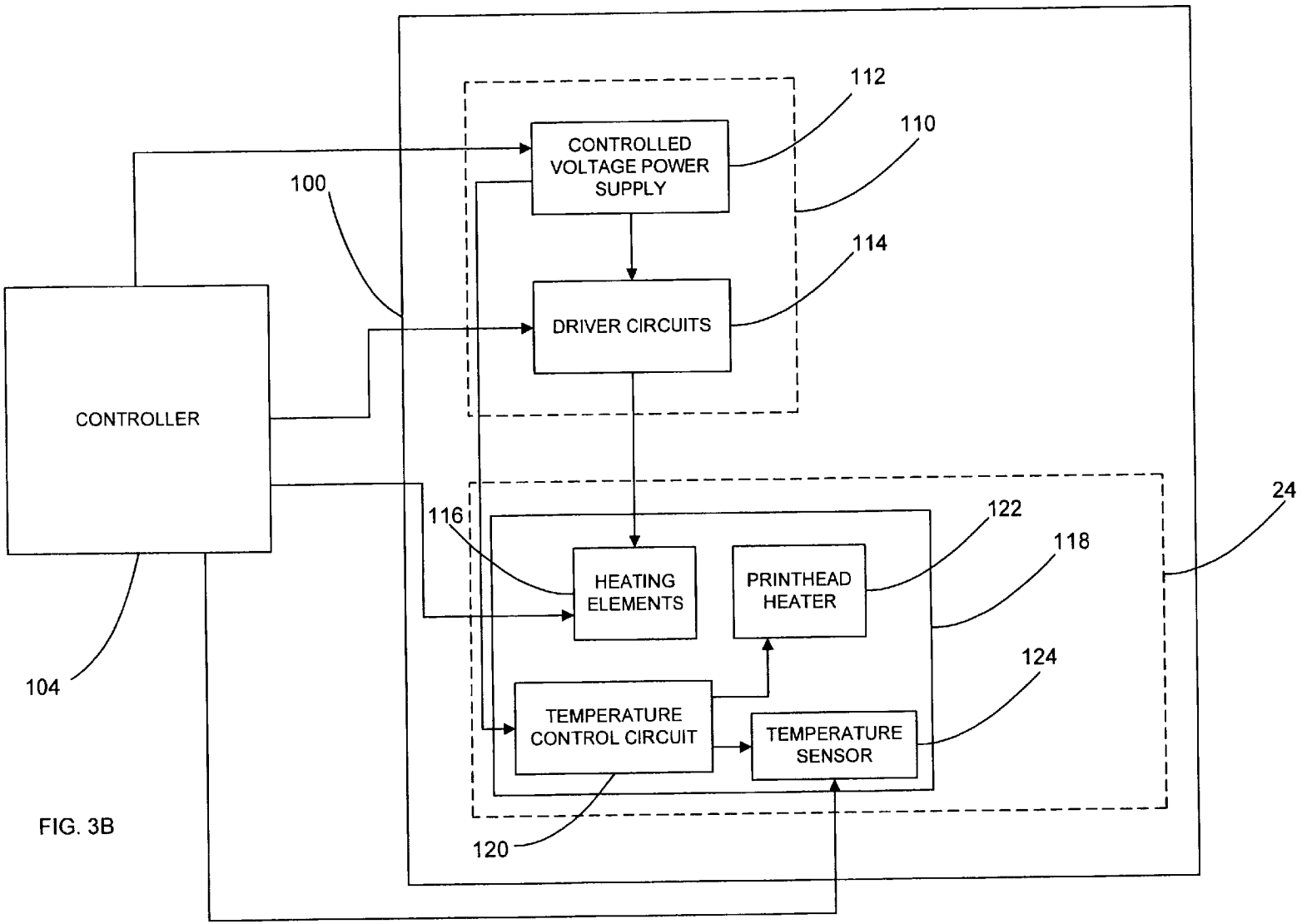

Shown in FIG. 3A and FIG. 3B are high level block diagrams of an inkjet printer.

Figure 4:
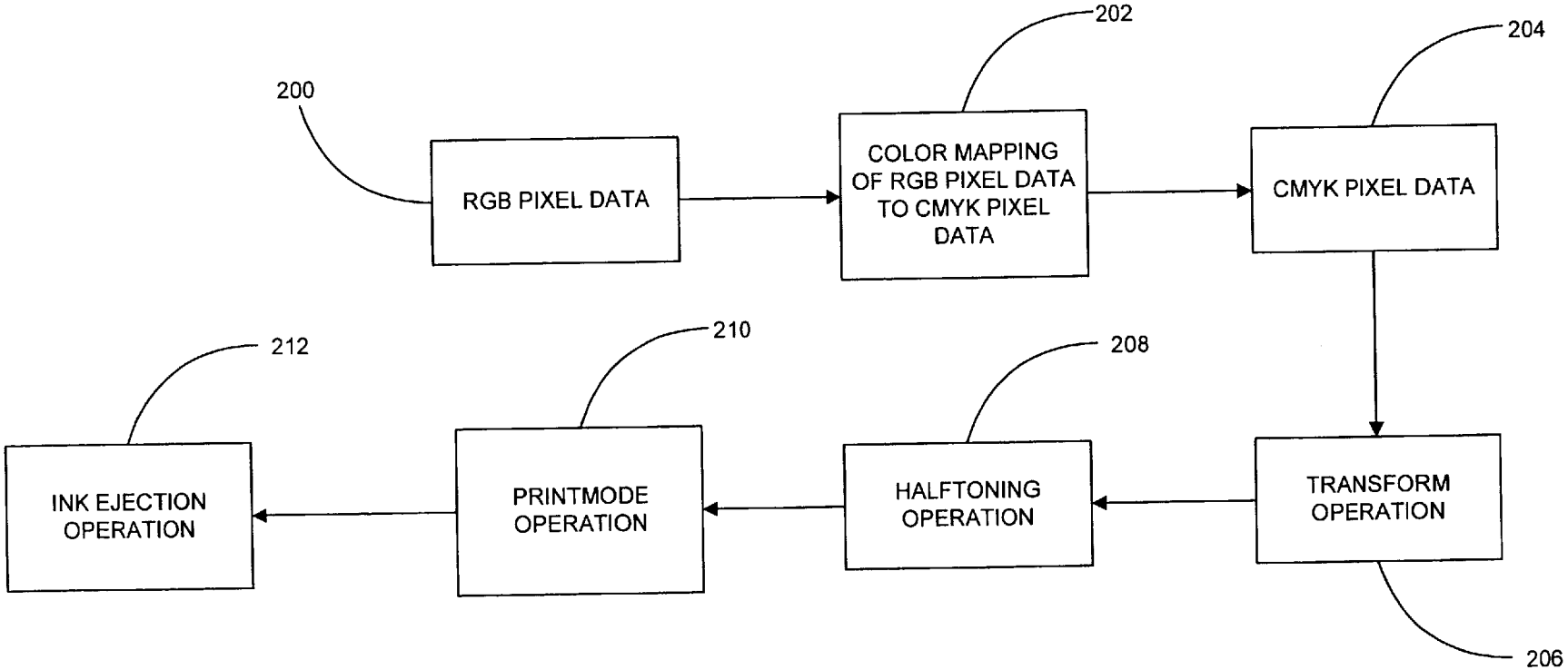

Shown in FIG. 4 is a high level conceptual block diagram of an embodiment of the temperature compensation system.

DETAILED DESCRIPTION OF THE DRAWINGS

An embodiment of the temperature compensation system will be discussed in the context of an inkjet printer. However, it should be recognized that embodiments of the temperature compensation system are applicable in a variety of imaging devices making use of thermal inkjet technology. For example, embodiments of the temperature compensation system could be used to improve the performance of large format inkjet plotters, facsimile machines using thermal inkjet technology, and copiers using thermal inkjet technology. Furthermore, although an embodiment of the temperature compensation system will be discussed in the context of an inkjet printer using a movable printhead, embodiments of the temperature compensation system can be usefully implied in inkjet printers having stationary printheads. In addition, although an embodiment of the temperature compensation system will be discussed in the context of a color inkjet printer, it will be recognized by understanding the information within this disclosure that embodiments of the temperature compensation system can be usefully applied in a monochrome inkjet imaging device.

Inkjet imaging devices such as printers, large format plotters/printers, facsimile machines and copiers have gained wide acceptance. These imaging devices are described by W. J. Lloyd and H. T. Taub in "Ink Jet Devices," Chapter 13 of Output Hardcopy Devices (Ed. R. C. Durbeck and S. Sherr, San Diego: Academic Press, 1988) and U.S. Pat. Nos. 4,490,728 and 4,313,684. The basics of this technology are further disclosed in various articles in several editions of the Hewlett-Packard Journal [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated into this specification by reference. Inkjet imaging devices can produce high quality images on media, are generally compact and portable, and form images on media quickly and quietly because only ink strikes the media.

An inkjet imaging device, such as an inkjet printer, forms a image by depositing a pattern of individual drops of ink on the media at particular locations of an array defined for the media. The locations are conveniently visualized as small dots in a rectilinear array. These locations are typically referred to as pixels. The imaging operation can be viewed as the filling of a pattern of pixels with drops of ink.

Inkjet imaging devices fill the pixels by ejecting very small drops of ink onto the media and typically include a movable carriage that supports one or more printheads each having ink ejecting nozzles. The carriage traverses over the surface of the media, and the nozzles are controlled to eject drops of ink at appropriate times pursuant to command of a microcomputer or other controller, wherein the timing of the application of the ink drops is intended to correspond to the pattern of pixels of the image being formed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the ink ejection element. When electric printing pulses activate the ink ejection element, a small portion of the ink next to it vaporizes and ejects a drop of ink from the printhead. Properly-arranged nozzles form a matrix pattern. Properly sequencing the operation of each nozzle causes characters or images to be printed upon the media as the printhead moves past the media.

The ink cartridge containing the nozzles is moved repeatedly across the width of the media upon which the image will be formed. At each of a designated number of increments of this movement across the media, each of the nozzles is caused either to eject ink or to refrain from ejecting ink according to output generated by the controlling microprocessor. Each completed movement across the media can deposited ink onto pixels forming a swath approximately as wide as the number of nozzles arranged in a column of the ink cartridge multiplied by the distance between nozzle centers, with the swath as long the dimension of the media parallel to the direction of relevant movement between the media and the printhead. After each such completed swath, the media is moved forward the width of the swath, and the ink cartridge begins the next swath. By proper selection and timing of the signals, the desired image is formed on the media.

In an inkjet printhead ink, is fed from an ink reservoir integral to the printhead or an "off-axis" ink reservoir which feeds ink to the printhead via tubes connecting the printhead and reservoir. Ink is then fed to the various ink ejection chambers either through an elongated hole formed in the center of the bottom of the substrate, "center feed," or around the outer edges of the substrate, "edge feed." In center feed the ink then flows through a central slot in the substrate into a central manifold area formed in a barrier layer between the substrate and a nozzle member, then into a plurality of ink channels, and finally into the various ink ejection chambers. In edge feed ink from the ink reservoir flows around the outer edges of the substrate into the ink channels and finally into the ink ejection chambers. In either center feed or edge feed, the flow path from the ink reservoir and the manifold inherently provides restrictions on ink flow to the ink ejection chambers.

Color inkjet imaging devices commonly employ a plurality of print cartridges, usually two to four, mounted in the printer carriage to produce a full spectrum of colors. In a printer with four cartridges, each print cartridge can contain a different color ink, with the commonly used base colors being cyan, magenta, yellow, and black. In a printer with two cartridges, one cartridge can contain black ink with the other cartridge being a tri-compartment cartridge containing the base color cyan, magenta and yellow inks, or alternatively, two dual-compartment cartridges may be used to contain the four color inks. In addition, two tri-compartment cartridges may be used to contain six base color inks, for example, black, cyan, magenta, yellow, light cyan and light magenta. Further, other combinations can be employed depending on the number of different base color inks to be used.

The base colors are produced on the media by depositing a drop of the required color onto a pixel location, while secondary or shaded colors are formed by depositing multiple drops of different base color inks onto the same or an adjacent pixel location, with the overprinting of two or more base colors producing the secondary colors according to well established optical principles.

In a color imaging operation, the various colored ink drops ejected by each of the print cartridges are selectively overlapped to create crisp images composed of virtually any color of the visible spectrum. To create a single pixel on media having a color which requires a blend of two or more of the colors provided by different print cartridges, the nozzle plates on each of the cartridges must be precisely aligned so that a drop ejected from a selected nozzle in one cartridge overlaps a drop ejected from a corresponding nozzle in another cartridge.

The print quality produced from an inkjet device is dependent upon the reliability and drop quantity repeatability of its ink ejection elements. A multi-pass print mode can partially mitigate the impact of the malfunctioning ink ejection elements on the print quality. The concept of printmodes is a useful and well-known technique of laying down in each pass of the printhead only a fraction of the total ink required in each section of the image, so that any areas left white in each pass are filled in by one or more later passes. This tends to control bleed, blocking and cockle by reducing the amount of liquid that is on the page at any given time.

The specific partial-inking pattern employed in each pass, and the way in which these different patterns add up to a single fully inked image, is known as a "printmode." Printmodes allow a trade-off between speed and image quality. For example, a printer's draft mode provides the user with readable text as quickly as possible. Presentation, also known as best mode, is slow but produces the highest image quality. Normal mode is a compromise between draft and presentation modes. Printmodes allow the user to choose between these tradeoffs. It also allows the printer to control several factors during printing that influence image quality, including: 1) the amount of ink placed on the media per pixel location, 2) the speed with which the ink is placed, and, 3) the number of passes required to complete the image. Providing different printmodes to allow placing ink drops in multiple swaths can assist in hiding nozzle defects. Different printmodes are also employed depending on the media type.

One-pass mode operation is used for increased throughput on plain paper media. Use of this mode on certain other types of paper media, such as coated paper, will result in dots resulting from the ink drops that are too large. In a one-pass mode, ink drops are placed onto all pixels onto which ink is to be deposited in the swath in one pass of the printhead across the swath. Then, the media is advanced into position for the next swath. In a two-pass printmode, one-half of the pixels available for ink deposition, on the rows of pixels forming the swath, are deposited on each of two passes of the printhead across the swath. Therefore, two passes are needed to complete the ink deposition for that swath. Similarly, a four-pass mode is a method of placing ink drops onto pixels where one fourth of the pixels onto which ink is to be deposited for the swath are deposited on each of four passes of the printhead across the swath. Furthermore, an eight-pass mode is a method of depositing ink onto pixels where one eighth of the pixels onto which ink is to be deposited for the swath are deposited on each eight passes of the printhead across the swath. Multiple pass thermal inkjet printing is described, for example, in commonly assigned U.S. Pat. Nos. 4,963,882 and 4,965,593, incorporated by reference into this specification in their entirety. In general, it is desirable to use the minimum number of passes for each swath to complete the imaging operation to maximize the printer throughput and to reduce undesirable visible printing artifacts.

The quantity of an ejected ink drop could be measured based upon the volume of the ejected ink drop, based upon the mass of the ejected ink drop, or based upon the weight of an ink drop. Typically, measurement of a quantity of an ejected ink drop is done in terms of mass. Therefore, this specification will discuss the operation of embodiments of the temperature compensation system in terms of the mass of ejected ink drops. However, it should be recognized that embodiments of the temperature compensation system could use values corresponding to ink drop volume, ink drop weight, or other measurements of the quantity of an ejected ink drop.

In forming an image on media, the color of a region of the image is related to the quantity of each of the different colors used to form the image in the area. In a small region of the image formed including a relatively low number of pixels, the color perceived from that region depends upon the relative quantity of the different colors of ink drops deposited onto the pixels. FIG. 1A and FIG. 1B are included to illustrate the difficulty in forming the image within the region so that it has the desired color when there are temperature related variations in ejected ink drop quantities. Consider the formation of a neutral gray color in the region through the deposition of predetermined quantities of cyan ink, yellow ink, and magenta ink. Shown in FIG. 1A is a representation of the formation of this neutral gray region in a L*a*b* color space. For the representation of the L*a*b* color space in FIG. 1A and FIG. 1B, the L* axis is perpendicular to the plane of the paper. With the proper quantities of each of the cyan ink, the yellow ink, and the magenta ink ejected onto the region (where the relative quantities of the different ink colors are represented by the positions of the dots in the L*a*b* color space of FIG. 1A), the resulting color of the region is at the neutral gray point (the intersection of the a* axis and the b* axis) as intended.

In general, the quantity of ink drops ejected from a printhead nozzle will change as the temperature of the structure surrounding the ink ejection chamber associated with the nozzle changes. Generally, the mass of ejected ink drops increases as the temperature of the structure surrounding the ink ejection chamber increases. The underlying physical effects that tend to increase the ejected ink drop mass include changes in ink surface tension, changes in ink viscosity, and changes in energy available for bubble nucleation. For the image formation of the region corresponding to FIG. 1A, each of the cyan, magenta, and yellow printheads operate at or near a nominal operating temperature so that when control signals intended to cause ejection of the quantities of ink necessary to form a neutral gray color in the region are supplied to the respective printheads, the respective printheads actually eject the quantities of ink onto the pixels necessary to form a neutral gray color region.

Now consider the condition in which the operating temperature of the magenta printhead increases beyond the nominal operating temperature. This may occur, for example, from an increased firing frequency of the magenta printhead. As a result of the temperature increase of the ink ejection chambers in the magenta printhead, the mass of a magenta ink drop ejected from nozzles in the magenta printhead will increase beyond the mass necessary (in combination with the ink drops ejected from the yellow printhead and the cyan printhead) to create the neutral gray color of the region corresponding to FIG. 1A. The color of the region resulting from the ejection of the excessive mass of magenta ink is represented by FIG. 1B. The effect of the increase in the mass of magenta ink deposited onto the region is represented in FIG. 1B by the shift of the magenta dot along the a* axis of the L*a*b* color space as compared to FIG. 1A. Perceptually, this corresponds to a shift in the color of the region away from the neutral gray toward a magenta color. The color shifting of this region reduces the fidelity of the image formed on the media. An embodiment of the temperature compensation system compensates for a temperature induced increase in the mass of magenta ink that would otherwise be deposited onto the region by reducing the number of drops of magenta ink ejected onto the region. It should be recognized that embodiments of the temperature compensation system could be used in monochrome inkjet imaging devices, such as an inkjet printer, that use a single color of ink. For example, where only black ink is used, the region shown in FIG. 1A would be formed by halftoning with black ink. The effect of the increase in the mass of black ink deposited onto the region would be a shift of the region along the L* axis toward the black end of the L* axis.

Although an embodiment of the temperature compensation system will be discussed in the context of an off-axis inkjet printer for which ink supply reservoirs are located remotely from the printheads, embodiments of the temperature compensation system may be usefully applied in inkjet printers having ink reservoirs included with the printheads in print cartridges.

Shown in FIG. 2 is a perspective view (with its cover removed) of an embodiment of an ink jet imaging device, inkjet printer 10, in which an embodiment of the temperature compensation system can operate. Inkjet printer 10 includes a media input tray 12 and support extension 14 for holding unused units of media 16. When an imaging operation is initiated, a unit of media 16 from media input tray 12 is moved into inkjet printer 10 using a media feeder. The unit of media 16 is moved through inkjet printer 10 in a U-shaped media path (so its direction of movement changes by 180 degrees) so that movement of the leading edge of the unit of media 16 is toward media output tray 18. The sheet is advanced to the input side of imaging zone 20. Carriage 22, supporting one or more printheads 24, is then moved across a swath of the unit of media 16 while ink is ejected onto the unit of media 16 to form the portion of the image corresponding to the swath. The ejection of ink may occur while the carriage is moving in either direction across the swath. This is referred to as bi-directional printing. After a single or multiple passes across the swath, the unit of media 16 is incrementally advanced using a conventional stepper motor and feed rollers to a next position within imaging zone 20 so that printheads 24 are positioned over the subsequent swath. Carriage 22 again moves across the unit of media 16 so that printheads 24 eject ink onto the unit of media 16 for this swath. When ink has been ejected onto all the necessary locations on the unit of media 16 to form the image, the imaging operation is complete. Then the unit of media 16 is moved in the media path to a position above media output tray 18, held in that position for a time sufficient to allow the ink to dry, and released into output tray 18.

Associated with carriage 22 are slide rod 26, along which carriage 22 slides, a flexible circuit (not shown in FIG. 2) for transmitting electrical signals from the printer's microprocessor to carriage 22, printheads 24 (including individual cyan, magenta, yellow, and black printheads), and coded strip 28. Regularly spaced markings on the surface of coded strip 28 are optically detected by a photo detector (not shown in FIG. 2) located on carriage 22 for precisely positioning carriage 22. A stepper motor (not shown in FIG. 2), connected to carriage 22 through a conventional drive belt and pulley arrangement, is used for moving carriage 22 (and printheads 24 which it carries) across imaging zone 20.

Additional systems within inkjet printer 10 include an ink delivery system for providing ink to printheads 24. The ink delivery system includes an off-axis ink supply station 30 containing replaceable ink supply cartridges 32, 34, 36, and 38 (each of which contain one of cyan, magenta, yellow, or black ink). Ink supply cartridges 32–38 may be pressurized or at atmospheric pressure. Four tubes 40 carry ink from the four replaceable ink supply cartridges 32–38 to the printheads 24, with one of the tubes supplying the one of the printheads 24 for the corresponding color.

Shown in FIG. 3A is a simplified block diagram of a system for forming images on media. Inkjet printer 10 includes an embodiment of an imaging mechanism, imaging mechanism 100. Imaging mechanism 100 includes the electronic and mechanical hardware and the firmware needed for forming an image on media 16 using ink. Imaging mechanism 100 includes printheads 24 used to eject ink onto media 16 according to signals received from printhead driver electronics 102. Controller 104 receives image data defining an image through interface 106 from computer 108. Generally, the image data originates from an application program executing on computer 108. The image data is typically expressed in a printer control language. From this image data, controller 104 generates print data corresponding to the image data. The print data is supplied to printhead driver electronics 110. The signals supplied by printhead driver electronics 102 to printheads 24 supply power to resistors used to heat ink in ink ejection chambers with printheads 24 so that ink is ejected and an image is formed on media 16 corresponding to the image data supplied by computer 108.

Shown in FIG. 3B is a simplified block diagram of a portion of imaging mechanism 100. Printhead driver electronics 110 includes controlled voltage power supply 112 and driver circuits 114. Controlled voltage power supply 112 supplies a voltage of a value controlled by controller 104. Driver circuits 114, under the direction of controller 104 apply voltage pulses to ink ejection chamber resistive heating elements 116 within printhead 118. Printhead 118 is included as one of printheads 24. Printhead 118 includes temperature control circuit 120. Temperature control circuit 120 controls the application of voltage pulses to printhead heater 122. Temperature control circuit 120 monitors the output of an embodiment of a temperature sensor, temperature sensor 124, to control the application of voltage pulses to printhead heater 122 so that printhead 118 is maintained at a substantially constant temperature while ink drops are not ejected from printhead 118. In addition controller 104 monitors the output of temperature sensor 124 which provides a value related to the temperature of printhead 118. Controller 104 is also coupled to temperature sensor 124 and receives the value related to the temperature of printhead 118. Alternatively, controller 104 could receive a temperature related value through temperature control circuit 120. Temperature sensor 124 could be implemented using a temperature sensitive resistive element or a band gap reference diode. The value representing the temperature of printhead 118 (and those of the other printheads) is used within an embodiment of the temperature compensation system to at least partially compensate for variations in ink drop mass.

Shown in FIG. 4 is a high level conceptual block diagram of the operations performed by an embodiment of the temperature compensation system, part of which is included within imaging mechanism 100. Block 200 represents pixel data provided in RGB form. The pixel data supplied from block 200 is represented, typically, by 8 bits for each of the red, green and blue colors. The 8 bits allow 256 values of intensity to be specified for each of the red, green, and blue colors. Block 202 represents a color mapping operation that transforms the RGB color values for each pixel into color values for a color space used with inkjet printer 10. Inkjet printer 10 makes use of a CMYK color space to form images on the media. Although operation of embodiments of the temperature compensation system will be discussed in the context of a four color system (cyan, magenta, yellow, and black), it should be recognized that embodiments of the temperature compensation system could be used in inkjet imaging devices having other color systems. For example, an embodiment of the temperature compensation system could be used in an inkjet printer making use of a six color system, dark cyan, light cyan, dark magenta, light magenta, yellow, and black.

Block 204 represents the results of the color mapping operation performed in block 202. The pixel data of block 204 includes four 8 bit values, with one of each of the 8 bit values representing the value for the cyan color, the magenta color, the yellow color, and the black color. The four 8 bit values corresponding to block 204 represent the relative strength of the cyan, magenta, yellow, and black colors for accurately reproducing the color of the pixel on the media. The transform performed by block 202 is designed to generate the relative strengths of the CMYK color values based upon a nominal drop mass for the particular printhead design used so that the color is accurately reproduced for the corresponding pixel on the media. However, as previously mentioned, temperature changes in the printheads can significantly shift the mass of ink drops ejected from the printheads so that without correction, the color will not be accurately reproduced for the corresponding pixel on the media.

Block 206 performs an embodiment of a transform operation on the color values provided by block 204 to compensate for temperature induced drop mass changes in the ink drops ejected from the nozzles within the printheads. The operations performed within block 204 include multiplying each of the CMYK color values from block 204 by a corresponding transform value. The operations performed within block 24 are represented by equations one through four as follows.

$$K'=K\times f(T_K) \quad \text{Eq. 1}$$

$$C'=C\times f(T_C) \quad \text{Eq. 2}$$

$$M'=M\times f(T_M) \quad \text{Eq. 3}$$

$$Y'=Y\times f(T_Y) \quad \text{Eq. 4}$$

Each of the functions $f(T_K)$, $f(T_C)$, $f(T_M)$, and $f(T_Y)$ in the above equations yield values dependent upon the temperatures of the printheads of the corresponding color. The functions are selected so that the resulting values of K', C', M', and Y' at least partially compensate for the effect of temperature induced changes in the mass of drops ejected from the printheads.

The particular functions $f(T_K)$, $f(T_C)$, $f(T_M)$, and $f(T_Y)$ necessary to compensate for temperature induced drop mass variations are dependent upon the characteristics of the particular printhead. For example, some printhead designs may exhibit a linear relationship between the mass of ejected ink drops and the temperature of the printhead. However, other printhead designs may exhibit a simple or complex non-linear relationship between the mass of ejected ink drops and the temperature. Regardless of the specific relationship between the temperature of the printhead and the mass of ejected ink drops a function can be determined to at least partially compensate for the change in the mass of ejected ink drops.

The embodiment of the transform operation performed by block 206 can compensate for temperature dependent variation in the mass of ejected ink drops from the printheads in either a linear or non-linear manner. The inputs provided to block 206 include the CMYK color values for each pixel supplied from block 204 and values corresponding to the temperatures measured for the cyan, magenta, yellow, and black printheads. From these input values provided to block 206, transformed color values (K'C'M'Y') for each pixel are determined from the input color values (KCMY) according to equation 1 through equation 4 using the corresponding temperature related values measured for the cyan, magenta, yellow, and black printheads. The effect of applying the functions of equations 1 through equation 4 to the respective KCMY color values is to reduce the color values corresponding to those printheads that have temperatures that have increased beyond a nominal printhead operating temperature. Particularly likely is the situation in which the image requires that printheads for one or two of the colors ejects a substantially higher number of drops than the remaining printheads. In this situation, those printheads having to eject the higher number of drops will experience significant increase in temperature and drop mass.

The transformed color values for each pixel are provided to block 208. Block 208 represents a halftoning operation performed on the transformed color values. The function of the halftoning operation is to convert the transformed color values for each pixel into halftone data that specifies a number of drops to be ejected onto each pixel for each of the colors. As previously mentioned, block 206 reduces the color values for the printheads that have increased in temperature above the nominal operating temperature. The effect of the reduction in the color values used in the halftoning operation is to reduce the number of drops of ink ejected for the respective KCMY ink colors so that the increased drop mass for those printheads experiencing a temperature rise above nominal is at least partially offset.

The halftoning operation performed in block 208 may be any halftoning operation that could be used in an imaging device. For example, the halftoning operation may include an error diffusion type halftone, a matrix type halftone, or some combination of these halftoning techniques. Consider a matrix halftoning operation. By supplying transformed color values that have been reduced from the color values supplied by block 204, there will be, over an area of the image such as a swath, fewer pixels for which the K', C', M', and Y' color values exceed the corresponding threshold matrix values. Consequently, fewer drops of those ink colors having pixels with reduced color values will be ejected onto the media.

Consider an error diffusion halftoning operation. In error diffusion halftoning operations the difference between the color values for a pixel and the corresponding threshold matrix values are cumulatively tracked. This cumulative difference value is distributed to surrounding pixels so that the color values of surrounding pixels are changed to account for the error between the threshold matrix value and the color values for the pixel. By supplying transformed color values that have been reduced from the color values supplied by block 204, there will be, over an area of the image such as a swath, fewer pixels for which the K', C', M', and Y' color values exceed the corresponding threshold matrix values. Consequently, fewer drops of those ink colors having pixels with reduced color values will be ejected onto the media. However, because of the way in which the cumulative difference is distributed among pixels, the effect of reducing the color values will be more distributed over the image than in the case of matrix halftoning. In either case, the number of drops of ink ejected onto the media for the colors having reduced color values will be reduced over the image to at least partially offset the increased drop mass of those inks.

As previously mentioned, embodiments of the temperature compensation system can be applied in a monochrome inkjet imaging device. In a monochrome inkjet printer, the color values supplied by block 200 would include only one value per pixel ranging between 0 and 255, corresponding to the different possible intensity levels of the single color used. The color mapping operation corresponding to block 202 would not be performed within a monochrome inkjet imaging device. In a monochrome inkjet printer where the color values have been reduced, the effect of the halftoning operation will be to reduce the number of drops of ink ejected onto the media over the image to at least partially offset the increased drop mass ejected by the printhead.

Block 210 represents the print mode operation. In block 210, the drops of ink that are to be deposited onto pixels for the various ink colors are assigned to be ejected onto the media on one or more passes of the printheads across the swath. The determination of the number of passes across the swath that will be performed and the assignment of drops of ink for the various ink colors to specific passes of the printheads across the swath is done to achieve the best print quality for the selected print mode. The number of drops of ink of the various colors that will be ejected for each of the pixels weighs in this determination. The output generated by block 210 corresponds to the drive signals supplied to printheads 24 by printhead driver electronics 102.

Block 212 represents the ink ejection operation performed by printheads 24. The output supplied by block 210 causes printheads 24 to eject ink of the correct colors onto the pixels to form the image corresponding to the image data received from the printer. Because the number of drops of the various colors have been changed to at least partially offset the effect of the temperature induced increase in the drop mass, the resulting image is closer to the ideal than it would have been absent the compensation.

One particular embodiment of the temperature compensation system makes use of an approximately linear relationship existing between the temperature of the printhead and the drop mass to determine the transformed color values. For this embodiment, each of functions $f(T_K)$, $f(T_C)$, $f(T_M)$, and $f(T_Y)$ are determined by equation 5 as:

$$f(T_n)=(dropnom_n)/[(dropnom_n)+C_n*(T_a-T_p)]$$

For equation 5, $dropnom_n$ corresponds to the nominal drop mass, $C_n$ (referred to as a drop mass temperature change value) corresponds to the drop mass change per degree Celsius, $T_a$ corresponds to the actual temperature of the corresponding printhead, and $T_p$ corresponds to a nominal temperature of that printhead established by supplying warming pulses to a resistive element within the printhead. The denominator of equation 5 corresponds to the actual drop mass at temperature $T_a$ expressed in terms of the nominal drop mass. The value of $C_n$ may be empirically determined. For one particular printhead design the empirically determined value of $C_n$ is one nano-gram per ten degrees Celsius and is substantially constant over an operating temperature range of the printheads. It should be recognized, however, that other printhead designs may yield other values for $C_n$. Furthermore, it should be recognized, that for some printhead designs, the value of $C_n$ may itself be a function of temperature. Using equation 5 to adjust the color values supplied by block 206 (as indicated in equation 1 through equation 4) has the effect of scaling these color values downward by the ratio of the nominal drop mass to the drop mass determined at temperature $T_a$. The scaling factor determined from equation 5 will typically be less than or equal to one because the nominal temperature of the printhead is controlled at a set point and ejecting ink drops from the printhead increases this temperature beyond this nominal value. However, if the value of $C_n$ were to be negative for a particular printhead design (which is unlikely because of the underlying physics affecting the performance of a printhead), then the scaling factor could be greater than one. It should be recognized that for some types of halftoning operations, non-linearly adjusting the color values as the drop mass changes may more effectively compensate for the drop mass changes.

Typically, the thermal time constant of printheads is in the range of seconds. As a result, the drop mass of ejected ink drops can change over relatively short time periods. Therefore, embodiments of the temperature compensation system generally perform most effectively when the halftoning operation is performed near the time at which ink drops will be ejected from the printhead to form regions of the image corresponding to the color values on which the halftoning operation was performed. For example, performing the halftoning operation on a particular swath before forming the image on the swath would allow for the ejection of drops based upon the transformed color values before substantial changes would occur in the corresponding printhead temperatures.

An embodiment of the temperature compensation system could be implemented within the image forming system shown in FIG. 3A and FIG. 3B. In this embodiment of the temperature compensation system, controller 104, executing firmware, performs the color mapping operations represented by block 202, the transform operation represented by block 206, the halftoning operation represented by block 208, and the print mode operation represented by block 210. Controller 104 uses a value corresponding to the temperature of each of printheads 24 (received from a temperature sensing element located on each of printheads 24) for performing the transform operation represented by block 206. The determination of the transformed color values includes determining the value of each of the functions $f(T_K)$, $f(T_C)$, $f(T_M)$, and $f(T_Y)$. Although determining values for the functions at the measured temperatures for each of the printheads could be done computationally with controller 104, it should be recognized that this determination could be accomplished using a look up table having values accessed using the respective printhead temperatures.

Although an embodiment of the temperature compensation system has been illustrated and described, it is readily apparent to those of ordinary skill in the art that various modifications may be made to this embodiment without departing from the scope of the appended claims.

What is claimed is:

1. A method, comprising:

receiving a value related to a temperature of a printhead;

determining a ratio of a first ink drop quantity value to a second ink drop quantity value corresponding to the temperature using the value, with the first ink drop quantity value corresponding to a first ink drop quantity ejected by the printhead at a nominal temperature; and transforming an intensity value using the ratio to form a transformed intensity value.

2. The method as recited in claim 1, wherein:

transforming the intensity value includes multiplying the ratio by the intensity value to form the transformed intensity value.

3. The method as recited in claim 2, further comprising:

determining the second ink drop quantity value as the first ink drop quantity value added to a drop quantity temperature change value multiplied by a magnitude of a difference between the temperature and the nominal printhead temperature.

4. The method as recited in claim 3, wherein:

the drop quantity temperature change value remains substantially constant over an operating temperature range of the printhead.

5. The method as recited in claim 4, wherein:

the drop quantity temperature change value corresponds to a drop mass temperature change value;

the first ink drop quantity value corresponds to a first ink drop mass; and the second ink drop quantity value corresponds to a second ink drop mass.

6. A method, comprising:

receiving a first value, a second value, a third value, and a fourth value related to, respectively, a first temperature, a second temperature, a third temperature, and a fourth temperature of, respectively a first printhead, a second printhead, a third printhead, and a fourth printhead;

determining a first ratio, a second ratio, a third ratio, and a fourth ratio of, respectively, a first nominal ink drop quantity value corresponding to a first nominal temperature, to a first ink drop quantity value corresponding to the first temperature, using the first value, a second nominal ink drop quantity value at a second nominal temperature, to a second ink drop quantity value corresponding to the second temperature, using the second value, a third nominal ink drop quantity value at a third nominal temperature, to a third ink drop quantity value corresponding to the third temperature, using the third value, and a fourth nominal ink drop quantity value at a fourth nominal temperature, to a fourth ink drop quantity value corresponding to the fourth temperature, using the fourth value; and forming a first transformed color value, a second transformed color value, a third transformed color value, and a fourth transformed color value using, respectively, a first color value, a second color value, a third color value, a fourth color value, the first ratio, the second ratio, the third ratio, and the fourth ratio.

7. The method as recited in claim 6, wherein:

the first printhead corresponds to a cyan ink printhead;

the second printhead corresponds to a magenta ink printhead;

the third printhead corresponds to a yellow ink printhead;

the fourth printhead corresponds to a black ink printhead;

the first color value corresponds to a cyan color value corresponding to a pixel;

the second color value corresponds to a magenta color value corresponding to the pixel;

the third color value corresponds to a yellow color value corresponding to the pixel; and the fourth color value corresponds to a black color value corresponding to the pixel.

8. The method as recited in claim 7, wherein:

the first nominal ink drop quantity value corresponds to a first cyan ink drop quantity value, the first ink drop quantity value corresponds to a second cyan ink drop quantity value, the second nominal ink drop quantity value corresponds to a first magenta ink drop quantity value, the second ink drop quantity value corresponds to a second magenta ink drop quantity value, the third nominal ink drop quantity value corresponds to a first yellow ink drop quantity value, the third ink drop quantity value corresponds to a second yellow ink drop quantity value, and the fourth nominal ink drop quantity value corresponds to a first black ink drop quantity value, the fourth ink drop quantity value corresponds to a second black ink drop quantity value.

9. The method as recited in claim 8, wherein:

forming the first transformed color value, the second transformed color value, the third transformed color value, and the fourth transformed color value includes multiplying the first ratio, the second ratio, the third ratio, and the fourth ratio by, respectively, the cyan color value, the magenta color value, the yellow color value, and the black color value.

10. The method as recited in claim 9, further comprising:

determining the second cyan ink drop quantity value as the first cyan ink drop quantity value added to a cyan drop quantity temperature change value multiplied by a magnitude of a first difference between the first temperature and the nominal cyan ink printhead temperature;

determining the second magenta ink drop quantity value as the first magenta ink drop quantity value added to a magenta drop quantity temperature change value multiplied by a magnitude of a second difference between the second temperature and the nominal magenta ink printhead temperature;

determining the second yellow ink drop quantity value as the first yellow ink drop quantity value added to a yellow drop quantity temperature change value multiplied by a magnitude of a third difference between the third temperature and the nominal yellow ink printhead temperature; and determining the second black ink drop quantity value as the first black ink drop quantity value added to a black drop quantity temperature change value multiplied by a magnitude of a fourth difference between the fourth temperature and the nominal black ink printhead temperature.

11. The method as recited in claim 10, wherein:

the cyan drop quantity temperature change value, the magenta drop quantity temperature change value, the yellow drop quantity temperature change value, and the black drop quantity temperature change value each remain substantially constant over an operating temperature range of the cyan printhead, the magenta printhead, the yellow printhead, and the black printhead.

12. The method as recited in claim 11, further comprising:

performing a halftoning operation using the first transformed color value, the second transformed color value, the third transformed color value, and the fourth transformed color value.

13. A temperature compensation system, comprising:

a temperature sensor configured to provide a signal related to a temperature of a printhead; and a controller arranged to receive the signal and configured to determine a ratio of a first ink drop quantity value corresponding to an ink drop quantity ejected by the printhead at a predetermined temperature to a second ink drop quantity value corresponding to the temperature of the printhead using the signal and configured to determine a transformed intensity value using the ratio and an intensity value.

14. The temperature compensation system as recited in claim 13, wherein:

the controller includes a configuration to determine the transformed intensity value by multiplying the ratio by the intensity value.

15. The temperature compensation system as recited in claim 14, wherein:

the controller includes a configuration to determine the second ink drop quantity value as the first ink drop quantity value added to a drop quantity temperature change value multiplied by a magnitude of a difference between the temperature of the printhead and the predetermined temperature.

16. The temperature compensation system as recited in claim 15, wherein:

the drop quantity temperature change value remains substantially constant over an operating temperature range of the printhead.

17. A temperature compensation system, comprising:

a first temperature sensor configured to provide a first signal related to a first temperature of a first printhead;

a second temperature sensor configured to provide a second signal related to a second temperature of a second printhead;

a third temperature sensor configured to provide a third signal related to a third temperature of a third printhead;

a fourth temperature sensor configured to provide a fourth signal related to a fourth temperature of a fourth printhead;

a controller arranged to receive the first signal, the second signal, the third signal, and the fourth signal, with the controller configured to determine a first ratio of a first nominal ink drop quantity value corresponding to a first predetermined temperature to a first ink drop quantity value corresponding to the first temperature using the first signal, to determine a second ratio of a second nominal ink drop quantity value corresponding to a second predetermined temperature to a second ink drop quantity value corresponding to the second temperature using the second signal, to determine a third ratio of a third nominal ink drop quantity value corresponding to a third predetermined temperature to a first ink drop quantity value corresponding to the first temperature using the third signal, to determine a fourth ratio of a fourth nominal ink drop quantity value corresponding to a fourth predetermined temperature to a fourth ink drop quantity value corresponding to the fourth temperature using the fourth signal, to determine a first transformed color value using the first ratio and a first color value, to determine a second transformed color value using the second ratio and a second color value, to determine a third transformed color value using the third ratio and a third color value, and to determine a fourth transformed color value using the fourth ratio and a fourth color value.

18. The temperature compensation system as recited in claim 17, wherein:

the first printhead corresponds to a cyan ink printhead;

the second printhead corresponds to a magenta ink printhead;

the third printhead corresponds to a yellow ink printhead;

the fourth printhead corresponds to a black ink printhead;

the first color value corresponds to a cyan color value corresponding to a pixel;

the second color value corresponds to a magenta color value corresponding to the pixel;

the third color value corresponds to a yellow color value corresponding to the pixel;

the fourth color value corresponds to a black color value corresponding to the pixel;

the first ink drop quantity value corresponds to a cyan drop quantity value;

the first nominal ink drop quantity value corresponds to a nominal cyan ink drop quantity value;

the second ink drop quantity value corresponds to a magenta ink drop quantity value;

the second nominal ink drop quantity value corresponds to a nominal magenta ink drop quantity value;

the third ink drop quantity value corresponds to a yellow ink drop quantity value;

the third nominal ink drop quantity value corresponds to a nominal yellow ink drop quantity value;

the fourth nominal ink drop quantity value corresponds to a nominal black ink drop quantity value; and the fourth ink drop quantity value corresponds to a black ink drop quantity value.

19. The temperature compensation system as recited in claim 18, wherein:

the controller includes a configuration to determine the first transformed color value, the second transformed color value, the third transformed color value, and the fourth transformed color value by multiplying the first ratio, the second ratio, the third ratio, and the fourth ratio by, respectively, the cyan color value, the magenta color value, the yellow color value, and the black color value.

20. The temperature compensation system as recited in claim 19, wherein:

the controller includes a configuration to determine the cyan ink drop quantity value as the nominal cyan ink drop quantity value added to a cyan drop quantity temperature change value multiplied by a magnitude of a first difference between the first temperature and the first predetermined temperature;

the controller includes a configuration to determine the magenta ink drop quantity value as the nominal magenta ink drop quantity value added to a magenta drop quantity temperature change value multiplied by a magnitude of a second difference between the second temperature and the second predetermined temperature;

the controller includes a configuration to determine the yellow ink drop quantity value as the nominal yellow ink drop quantity value added to a yellow drop quantity temperature change value multiplied by a magnitude of a third difference between the third temperature and the third predetermined temperature; and the controller includes a configuration to determine the black ink drop quantity value as the nominal black ink drop quantity value added to a black drop quantity temperature change value multiplied by a magnitude of a fourth difference between the fourth temperature and the fourth predetermined temperature.

21. The temperature compensation system as recited in claim 20, wherein:

the cyan drop quantity temperature change value, the magenta drop quantity temperature change value, the yellow drop quantity temperature change value, and the black drop quantity temperature change value each remain substantially constant over an operating temperature range of the cyan printhead, the magenta printhead, the yellow printhead, and the black printhead.

22. The temperature compensation system as recited in claim 21, wherein:

the cyan drop quantity temperature change value, the magenta drop quantity temperature change value, the yellow drop quantity temperature change value, and the black drop quantity temperature change value each substantially equal a predetermined value.

23. An inkjet imaging device to form an image on media corresponding to image data, comprising:

a printhead arranged to receive drive signals and configured to eject ink onto the media according to the drive signals;

a temperature sensor configured to provide a signal related to a temperature of the printhead;

a controller arranged to receive the signal and the image data and configured to determine a ratio of a first ink drop quantity value corresponding to an ink drop quantity ejected by the printhead at a nominal temperature to a second ink drop quantity value corresponding to the temperature using the signal, configured to determine an intensity value from the image data, configured to determine a transformed intensity value using the ratio and the intensity value, and configured to generate data using the transformed intensity value; and a driver circuit arranged to receive the data and configured to generate the drive signals according to the data.

24. The inkjet imaging device as recited in claim 23, wherein:

the controller includes a configuration to determine the transformed intensity value by multiplying the ratio by the intensity value.

25. The inkjet imaging device as recited in claim 24, wherein:

the controller includes a configuration to determine the second ink drop quantity value as the first ink drop quantity value added to a drop quantity temperature change value multiplied by a magnitude of a difference between the temperature and the nominal temperature.

26. The inkjet imaging device as recited in claim 25, wherein:

the drop quantity temperature change value remains substantially constant over an operating temperature range of the printhead.

27. The inkjet imaging device as recited in claim 26, wherein:

the drop quantity temperature change value corresponds to a drop mass temperature change value;

the first ink drop quantity value corresponds to a first ink drop mass; and the second ink drop quantity value corresponds to a second ink drop mass.

28. An inkjet imaging device to form an image on media corresponding to image data, comprising:

a first printhead arranged to receive a first set of drive signals and configured to eject ink onto the media according to the first set of drive signals;

a first temperature sensor configured to provide a first signal related to a first temperature of the first printhead;

a second printhead arranged to receive a second set of drive signals and configured to eject ink onto the media according to the second set of drive signals;

a second temperature sensor configured to provide a second signal related to a second temperature of the second printhead;

a third printhead arranged to receive a third set of drive signals and configured to eject ink onto the media according to the third set of drive signals;

a third temperature sensor configured to provide a third signal related to a third temperature of the third printhead; and a fourth printhead arranged to receive a fourth set or drive signals and configured to eject ink onto the media according to the fourth set of drive signals;

a fourth temperature sensor configured to provide a fourth signal related to a fourth temperature of the fourth printhead;

a controller arranged to receive the first signal, the second signal, the third signal, and the fourth signal and configured to determine a first ratio of a first nominal ink drop quantity value corresponding to a first nominal temperature to a first ink drop quantity value corresponding to the first temperature, to determine a second ratio of a second nominal ink drop quantity value corresponding to a second nominal temperature to a second ink drop quantity value corresponding to the second temperature, to determine a third ratio of a third nominal ink drop quantity value corresponding to a third nominal temperature to a third ink drop quantity value corresponding to the fourth temperature, to determine a first color value from the image data, to determine a second color value from the image date, to determine a third color value from the image data, to determine a fourth color value from the image data, to determine a first transformed color value using the first ratio and the first color value, to determine a second transformed color value using the second ratio and the second color value, to determine a third transformed color value using the third ratio and the third color value, and to determine a fourth transformed color value using the fourth ratio and the fourth color value; and a driver circuit configured to generate, the first set of drive signals, the second set of drive signals, the third set of drive signals, and the fourth set of drive signals from, respectively, the first transformed color value, the second transformed color value, the third transformed color value, and the fourth transformed color value.

29. The inkjet imaging device as recited in claim 28, wherein:

the first printhead corresponds to a cyan ink printhead;

the second printhead corresponds to a magenta ink printhead;

the third printhead corresponds to a yellow ink printhead;

the fourth printhead corresponds to a black ink printhead;

the first color value corresponds to a cyan color value corresponding to a pixel;

the second color value corresponds to a magenta color value corresponding to the pixel;

the third color value corresponds to a yellow color value corresponding to the pixel; and the fourth color value corresponds to a black color value corresponding to the pixel.

* * * * *

UNITED STATES PATENT AND TRADEMARK OFFICE

CERTIFICATE OF CORRECTION

PATENT NO. : 6,648,442 B2
DATED : November 18, 2003
INVENTOR(S) : Bauer

It is certified that error appears in the above-identified patent and that said Letters Patent is hereby corrected as shown below:

Column 17,
Line 14, delete “or” and insert therefor -- of --.

Signed and Sealed this

Twenty-fourth Day of August, 2004

JON W. DUDAS
*Director of the United States Patent and Trademark Office*